US006436206B1

(12) United States Patent
Bhargava

(10) Patent No.: US 6,436,206 B1
(45) **Date of Patent: *Aug. 20, 2002**

(54) COPPER ALLOY AND PROCESS FOR OBTAINING SAME

(75) Inventor: Ashok K. Bhargava, Cheshire, CT (US)

(73) Assignee: Waterbury Rolling Mills, Inc., Waterbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/311,038

(22) Filed: Apr. 1, 1999

(51) Int. Cl.[7] ..... C22F 1/08
(52) U.S. Cl. ..... 148/554; 148/681; 148/682; 148/685
(58) Field of Search ..... 148/554, 681, 148/682, 685

(56) References Cited

U.S. PATENT DOCUMENTS

| | | | |
|---|---|---|---|
| 2,062,427 | A | 12/1936 | Pierson |
| 3,923,558 | A | 12/1975 | Shapiro et al. |
| 4,486,250 | A | 12/1984 | Nakajima |
| 4,511,410 | A | 4/1985 | Shapiro et al. |
| 4,586,967 | A | 5/1986 | Shapiro et al. |
| 4,605,532 | A | 8/1986 | Knorr et al. |
| 4,627,960 | A | 12/1986 | Nakajima et al. |
| 4,666,667 | A | 5/1987 | Kamio et al. |
| 4,732,731 | A | 3/1988 | Asai et al. |
| 4,822,562 | A | 4/1989 | Miyafuji et al. |
| 4,935,076 | A | 6/1990 | Yamaguchi et al. |
| 4,971,758 | A | 11/1990 | Suzuki et al. |
| 5,024,814 | A | 6/1991 | Futatasuka et al. |
| 5,288,457 | A | 2/1994 | Boegel |
| 5,387,293 | A | 2/1995 | Endo et al. |
| 5,508,001 | A | 4/1996 | Suzuki et al. |
| 5,820,701 | A | 10/1998 | Bhargava |
| 5,865,910 | A | 2/1999 | Bhargava |
| 5,893,953 | A | 4/1999 | Bhargava |
| 5,916,386 | A | 6/1999 | Bhargava |
| 5,985,055 | A | 11/1999 | Bhargava |
| 6,099,663 | A | 8/2000 | Bhargava |

FOREIGN PATENT DOCUMENTS

| | | | |
|---|---|---|---|
| JP | 57-002849 | | 1/1982 |
| JP | 58-147139 | | 9/1983 |
| JP | 59-31839 | | 2/1984 |
| JP | 59-56552 | | 4/1984 |
| JP | 60-121245 | | 6/1985 |
| JP | 62-116745 | | 5/1987 |
| JP | 2-122035 | | 5/1990 |
| JP | 3-002341 | | 1/1991 |
| JP | 3-031437 | | 2/1991 |
| JP | 3-087341 | | 4/1991 |
| JP | 3-294461 | | 12/1991 |
| JP | 4141561 | * | 5/1992 |
| JP | 6-073474 | | 3/1994 |
| JP | 6-184679 | | 7/1994 |
| JP | 6-220594 | | 8/1994 |

OTHER PUBLICATIONS

"Metals Handbook", 9th Edition, vol. 2–Properties and Selection: Nonferrous Alloys and Pure Metals, pp. 354–356, 1991.

* cited by examiner

*Primary Examiner*—Sikyin Ip
(74) *Attorney, Agent, or Firm*—Gregory S. Rosenblatt; Wiggin & Dana

(57) ABSTRACT

The present invention relates to copper base alloys containing tin, phosphorous, iron, and zinc and having phosphide particles uniformly distributed through the alloy matrix, which phosphide particles include fine and coarse phosphide particles. The alloy is produced using a process which comprises casting a copper base alloy consisting essentially of tin in an amount greater than about 1.5 wt. % up to 4.0 wt. %, phosphorous from 0.01 to 0.20 wt. %, iron from 0.01 to 0.80 wt. %, zinc in an amount greater than 1.0 wt. % up to 8.0 wt. %, and the balance essentially copper; homogenizing at least once for at least one hour at from 1000° F. to 1450° F.; rolling to final gauge including at least one process anneal for at least one hour at 650° F. to 1200° F. followed by slow cooling, preferably at a rate in the range of 20° F. to 200° F. per hour; and stress relief annealing at final gauge for at least one hour at 300° F. to 600° F.

15 Claims, No Drawings

COPPER ALLOY AND PROCESS FOR OBTAINING SAME

BACKGROUND OF THE INVENTION

There is a variety of copper base alloys that are used in connector, lead frame and other electrical applications because their special properties are suitable for these applications. However, there is a need for copper base alloys that can be used in applications that require high yield strength in the order of 80–100 KSI, together with good forming properties that allow one to make 1800 badway bends with a R/T ratio of 1 or less plus good electrical conductivities of 30% or better, plus low relaxation of stress at elevated temperatures and freedom of stress corrosion cracking. These represent a highly desirable combination of properties. Alloys presently available do not meet all of these requirements or have high costs that make them less economical in the marketplace or have other significant drawbacks. It is highly desirable to develop a copper base alloy satisfying the foregoing goals.

Beryllium copper generally has very high strength and conductivity along with good stress relaxation characteristics; however, these materials are limited in their forming ability. One such limitation is the difficulty with 180° badway bends. In addition, they are very expensive and often require extra heat treatment after preparation of a desired part. Naturally, this adds even further to the cost.

Phosphor bronze materials are inexpensive alloys with good strength and excellent forming properties. They are widely used in the electronic and telecommunications industries. However, they tend to be undesirable where they are required to conduct very high current under very high temperature conditions, such as for example under conditions found in automotive applications for use under the hood. This combined with their high thermal stress relaxation rate makes these materials less suitable for many applications.

High copper high conductivity alloys also have many desirable properties, but generally do not have mechanical strength desired for numerous applications. Typical of these alloys include but are not limited to copper alloys 110, 122, 192 and 194.

Representative prior art patents include U.S. Pat. Nos. 4,666,667, 4,627,960, 2,062,427, 4,605,532, 4,586,967 and 4,822,562.

Accordingly, it is highly desirable to develop the copper base alloys having a combination of desirable properties making them eminently suitable for many applications.

SUMMARY OF THE INVENTION

In accordance with the present invention, it has been found that the foregoing objective is readily obtained.

Copper base alloys of the present invention consist essentially of tin in an amount from 1 and up to 4%, and preferably in an amount greater than 2.5% up to 4.0%, phosphorous from 0.01 to 0.2% and particularly from 0.01 to 0.05%, iron from 0.01 to 0.80% and preferably 0.05 to 0.8% and particularly from 0.05 to 0.25%, zinc from 0.1 to 12% and preferably 0.3 to 5.0%, and the balance essentially copper. It is particularly advantageous to include nickel and/or cobalt in the alloy in an amount from 0.001 to 0.5% each. It is desirable and advantageous to provide particles of iron phosphide and/or iron nickel phosphide and/or iron magnesium phosphide and/or magnesium nickel phosphide and/or magnesium phosphide or a combination thereof, uniformly distributed throughout the matrix. The phosphide particles have a particle size of 50 Angstroms to 0.3 microns and generally and advantageously include a finer component and a coarser component. The finer component has a particle size of 50–250 Angstroms preferably from 50–200 Angstroms, and the coarser component has a particle size generally from 0.075 to 0.3 microns and preferably from 0.075 to 0.125 microns.

Percentage ranges throughout this application are percentages by weight.

The alloys of the present invention have been found to enjoy a variety of excellent properties making them eminently suitable for use as connectors, lead frames, springs and other electrical applications. The alloys have an excellent and unusual combination of mechanical strength, formability, thermal and electrical conductivities, and stress relaxation properties.

The process of the present invention comprises: casting a copper base alloy having a composition as aforesaid; homogenizing at least once for at least one hour at from 1000–1450° F.; rolling to final gauge including at least one process anneal for at least one hour at 650–1200° F. followed by slow cooling at 20–200° F. per hour; and stress relief annealing at final gauge for at least one hour at 300–600° F., thereby obtaining a copper alloy including phosphide particles uniformly distributed throughout the matrix with a size and distribution as aforesaid. Nickel and/or cobalt may be included in the alloy as above.

DETAILED DESCRIPTION

The preferred alloys of the present invention and the first embodiment includes tin from 2.5–4%, phosphorus from 0.01–0.20%, iron from 0.05–0.80%, zinc from 0.3–5%, balance essentially copper, with phosphide particles uniformly distributed throughout the matrix. These alloys of the present invention have a 0.2% offset yield strength of 80 to 100 KSI along with the ability of the alloys to make 180° badway bends at a radius no more than the thickness of the alloy strip. In addition, the alloys achieve an electrical conductivity of approximately 30% IACS or better which makes the alloys suitable for high current applications. The foregoing combined with a good thermal conductivity of 75 BTU/SQ FT/FT/HR/DEGREE F and a metallurgical structure that give the alloys a high stress retention ability, for example, over 60% at 150° C., after 1,000 hours with a stress equal to 75% of its yield strength, on samples cut parallel to direction of rolling, makes these alloys very suitable for the high temperature conditions under an automobile hood as well as other applications requiring a combination of high conductivity and high stress retention capabilities. Moreover, the present alloys do not require further treatment by stampers and are relatively inexpensive.

As indicated hereinabove, the alloys of the present invention preferably include tin in an amount greater than 2.5% and up to 4.0%, phosphorous is present in an amount from 0.01 to 0.2% and particularly 0.01 to 0.05%. Phosphorous allows the metal to stay deoxidized making it possible to cast sound metal within the limits set for phosphorous, and with thermal treatment of the alloys phosphorous forms a phosphide with iron and/or iron and nickel and/or iron and magnesium or combinations of these elements, if present, which significantly reduces the loss in conductivity that would result if these materials were entirely in solid solution in the matrix. It is particularly desirable to provide iron phosphide particles uniformly distributed throughout the matrix as these help improve the stress relaxation properties by blocking dislocation movement.

Iron in the range of 0.05 to 0.8% and particularly 0.05 to 0.25% increases the strength of the alloys, promotes a fine grain structure by acting as a grain growth inhibitor and in combination with phosphorous in this range helps improve the stress relaxation properties without negative effect on electrical and thermal conductivities.

Zinc in the range of 0.3 to 5.0% helps deoxidize the metal, helping the castings to be sound without use of excessive phosphorous that can hurt conductivities. Zinc also helps in keeping the metal oxide free for good adhesion in plating. It is desirable to restrict the upper zinc level under 5.0% and particularly under 2.5% in order to keep the conductivities high. Zinc in the lower amounts of this range will achieve even higher conductivities.

Nickel and/or cobalt in an amount from 0.001 to 0.5% each, and preferably 0.01 to 0.3% each, are desirable additives since they improve stress relaxation properties and strength by refining the grain and through distribution throughout the matrix, with a positive effect on the conductivity. Nickel is preferred.

One may include one or more of the following elements in the alloy combination: aluminum, silver, boron, beryllium, calcium, chromium, cobalt, indium, lithium, magnesium, manganese, zirconium, lead, silicon, antimony and titanium. These materials may be included in amounts less than 0.1% each generally in excess of 0.001 each. The use of one or more of these materials improves mechanical properties such as stress relaxation properties; however, larger amounts may effect conductivity and forming properties.

The process of the present invention includes casting an alloy having a composition as aforesaid, and including at least one homogenization for at least one hour, and preferably for 2–20 hours, at 1000–1450° F. At least one homogenization step may be conducted after a rolling step. The casting process forms a tin-copper compound and the homogenization treatment breaks up the unstable tin-copper compound and puts the tin in solution.

The material is rolled to final gauge, including at least one process anneal at 650–1200° F. for at least one hour and preferably for 2–20 hours, followed by slow cooling to ambient at 20–200° F. per hour.

The material is stress relief annealed at final gauge at 300–600° F. for at least one hour and preferably for 2–16 hours. This advantageously improves formability and stress relaxation properties.

The thermal treatments form the desirable particles of phosphides of iron or nickel or magnesium or combinations thereof and uniformly distributes same throughout the matrix, and aids in obtaining the improved properties of the alloy of the present invention. The phosphide particles have a particle size of 50 Angstroms to 0.3 microns and generally and advantageously include a finer component and a coarser component. The finer component has a particle size of 50–250 Angstroms preferably from 50–200 Angstroms, and the coarser component has a particle size generally from 0.075 to 0.3 microns and preferably from 0.075 to 0.125 microns.

As an alternative and second embodiment, the present invention includes an alloy containing tin in an amount from 1.0% and up to 4.0%, zinc from 0.1 to less than 1%, balance essentially copper. The phosphorus and iron contents are as in the first embodiment, and nickel and/or cobalt may be added as in the first embodiment, with phosphide particles as aforesaid.

The above second embodiment alloy is processed as in the first embodiment alloy and is capable of achieving an electrical conductivity of approximately 33% IACS or better which makes the alloy suitable for high current applications. The foregoing combined with a good thermal conductivity of 82 BTU/SQ FT/FT/HR/DEGREE F and a metallurgical structure that gives the alloy a high stress retention ability of over 60% at 150° C. after 1,000 hours with a stress equal to 75% of its yield strength on samples cut parallel to direction of rolling, makes this alloy as suitable for high temperature conditions as the previous alloy.

This alloy also forms phosphides as with the first embodiment alloy. Also, the additional alloying ingredients noted for the first embodiment alloy may be used for this alloy. This alloy is capable of achieving the following properties:

| Tensile Strength (KSI) | Yield Strength 0.2% Offset (KSI) | Elongation % | Bend Properties 180D Badway Bend (Width: Thickness Ratio Up to 10:1) |
|---|---|---|---|
| 80–100 | 80–100 | 5–10 | Radius: Thickness Ratio = 1 |

As a third embodiment alloy, the present invention includes an alloy containing tin in an amount from 1.0% and up to 4.0%, tin and zinc from 1 to 6%, balance essentially copper. The phosphorus and iron contents are as in the first embodiment and nickel and/or cobalt are added in the amount of 0.11 to 0.50% each, and phosphide particles are present as in the first embodiment.

The above third embodiment alloy is processed as for the first embodiment and is capable of achieving electrical conductivity of approximately 32% or better which makes the alloy suitable for high current applications. The foregoing combined with a good thermal conductivity of 80 BTU/SQ FT/FT/HR DEGREE F and a metallurgical structure that gives the alloy a high stress retention ability of over 60% at 150° C. after 1,000 hours with a stress equal to 75% of its yield strength, on samples cut parallel to direction of rolling, makes this alloy as suitable for high temperature conditions as the previous alloys.

This alloy also forms phosphides as with the first embodiment alloy. Also, the additional alloying ingredients noted for the first embodiment alloy may be used for this alloy. This alloy is capable of achieving the following properties:

| Tensile Strength (KSI) | Yield Strength 0.2% Offset (KSI) | Elongation % | Bend Properties 180D Badway Bend (Width: Thickness Ratio Up to 10:1) |
|---|---|---|---|
| 85–100 | 85–100 | 5–10 | Radius: Thickness Ratio = 1 |

As a fourth embodiment alloy, the present invention includes an alloy containing tin in an amount from 1.0% up to 4.0% and zinc from 6 to 12%, balance essentially copper. The phosphorus and iron contents are as in the first embodiment and nickel and/or cobalt may be added as in the first embodiment, and phosphide particles are present as in the first embodiment.

The above alloy is processed as for the first embodiment and is capable of achieving electrical conductivity of approximately 30% which makes the alloy suitable for high current applications. The foregoing combined with a good thermal conductivity of 75 BTU/SQ FT/FT/HR/DEGREE F and a metallurgical structure that is capable of giving the alloy a high stress retention ability of over 60% at 150° C. after 1,000 hours with a stress equal to 75% of its yield strength, on samples cut parallel to direction of rolling, makes this alloy as suitable for high temperature conditions as the previous alloys.

This alloy also forms phosphides as with the first embodiment alloy. Also, the additional alloying ingredients noted for the first embodiment alloy may be used for this alloy. This alloy is capable of achieving the following properties:

| Tensile Strength (KSI) | Yield Strength 0.2% Offset (KSI) | Elongation % | Bend Properties 180D Badway Bend (Width: Thickness Ratio Up to 10:1) |
|---|---|---|---|
| 90–105 | 85–100 | 5–10 | Radius: Thickness Ratio = 1 |

As a fifth embodiment alloy, the present invention includes an alloy containing tin in an amount from 1.0% up to 4.0%, zinc from 1 to 6% and iron from 0.01 to 0.05%, balance essentially copper. The phosphorus content is as in the first embodiment alloy and nickel and/or cobalt may be added as in the first embodiment, and phosphide particles are present as in the first embodiment.

The above alloy is processed as in the first embodiment and is capable of achieving electrical conductivity of approximately 33% which makes the alloy suitable for high current applications. The foregoing combined with a good thermal conductivity of 82 BTU/SQ FT/FT/HR/DEGREE F and a metallurgical structure that is capable of giving the alloy a high stress retention ability of over 60% at 150° C. after 1,000 hours with a stress equal to 75% of its yield strength, on samples cut parallel to direction of rolling, makes this alloy as suitable for high temperature conditions as the previous alloys.

This alloy also forms phosphides as with the first embodiment alloy. Also, the additional alloying ingredients noted for the first embodiment alloy may be used for this alloy. This alloy is capable of achieving the following properties:

| Tensile Strength (KSI) | Yield Strength 0.2% Offset (KSI) | Elongation % | Bend Properties 180D Badway Bend (Width: Thickness Ratio Up to 10:1) |
|---|---|---|---|
| 80–100 | 80–100 | 5–10 | Radius: Thickness Ratio = 1 |

The present invention will be more readily understood from a consideration of the following examples.

EXAMPLE 1

An alloy having the following composition: tin-2.7%; phosphorous-0.04%; iron-0.09%; zinc-2.2%; nickel-0.12%; balance essentially copper was cast using a horizontal continuous casting machine in a thickness of 0.620" and width of 15". The material was thermally treated at 1350° F. for 14 hours followed by milling to remove 0.020" per side. The alloys were then cold rolled to 0.360" followed by another thermal treatment at 1350° F. for 12 hours and another milling of 0.20" per side to enhance the surface quality. The material was then cold rolled on a 2-high mill to 0.120" followed by bell annealing at 1000° F. for 12 hours. The materials were then further cold worked and thermally treated at 750° F. and 690° F. at 8 and 11 hours, respectively, followed by slow cooling, followed by finish rolling to final gauge at 0.0098". Material samples were finally stress relief annealed at 425° F. and 500° F. for 4 hours, respectively.

The materials were tested for mechanical properties and forming properties to determine the capabilities to make bends at angles up to 180° at different radii. The results are shown in TABLE I, below. The samples were characterized by the presence of iron-nickel-phosphide-particles distributed throughout the matrix.

TABLE I

| | Tensile Strength (KSI) | 0.2% Offset Yield Strength (KSI) | Elongation 2" Gauge Length | Min. R/T* Ratio For 180° Badway Bend |
|---|---|---|---|---|
| As Rolled | 96 | 93 | 2 | 1 |
| Relief Annealed at 425° F. | 92 | 91.5 | 7 | <1 |
| Relief Annealed at 500° F. | 90 | 87 | 11 | <1 |

*sample width equals 10× thickness

EXAMPLE 2

The procedure of Example 1 was repeated using a 500° F. stress relief anneal and with an alloy having the following composition.

| | |
|---|---|
| tin | 2.7% |
| phosphorous | 0.03% |
| iron | 0.09% |
| zinc | 1.3% |
| nickel | 0.08% |
| copper | essentially balance |

The results are shown in Table II, below. The samples were characterized by the presence of iron-nickel-phosphide particles distributed throughout the matrix.

TABLE II

| | Tensile strength (KSI) | Elongation 2" Gauge Length |
|---|---|---|
| Relief Annealed at 500° F. | 90 | 10% |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. Process for preparing copper base alloys which comprises: casting a copper base alloy consisting essentially of tin in an amount greater than about 1.5 wt. % up to 4.0 wt. %, phosphorous from 0.01 to 0.20 wt. %, iron from 0.01 to 0.80 wt. %, zinc in an amount greater than 1.0 wt. % up to 8.0 wt. %, and the balance essentially copper; homogenizing at least once for at least one hour at from 1000–1450° F.; rolling to final gauge including at least one process anneal for at least one hour at 650–1200° F. followed by slow cooling at a rate in the range of 20° F.–200° F./hour; and stress relief annealing at final gauge for at least one hour at 300–600° F., thereby obtaining a copper alloy including phosphide particles uniformly distributed throughout the matrix of said copper base alloy.

2. Process according to claim 1, wherein said casting step includes casting said copper base alloy with a material selected from the group consisting of nickel, cobalt, and mixtures thereof in an amount from 0.001 to 0.5 wt. % each.

3. Process according to claim 2, wherein said material is nickel and where said casting step further includes adding up to 0.1% by weight magnesium.

4. Process according to claim 3, wherein said phosphide particles are selected from the group consisting of iron nickel phosphide particles, iron magnesium phosphide particles, iron phosphide particles, magnesium nickel phosphide particles, magnesium phosphide and mixtures thereof.

5. Process according to claim 1, including two homogenization steps wherein at least one homogenization is after a rolling step and wherein the homogenization steps are for 2 to 20 hours each.

6. Process according to claim 1, wherein said at least one process anneal is for 2 to 20 hours.

7. Process according to claim 1, wherein said stress relief anneal is for 2 to 16 hours.

8. Process according to claim 1, wherein said process obtains phosphide particles having a particle size of from 50 Angstroms to 0.3 microns.

9. Process according to claim 8, wherein said process obtains phosphide particles including fine particles and coarse particles with said fine particles having a particle size from 50 to 250 Angstroms and said coarse particles having a particle size from 0.075 to 0.3 microns.

10. Process according to claim 1, wherein said casting step further includes adding at least one material selected from the group consisting of aluminum, silver, boron, beryllium, calcium, chromium, cobalt, indium, lithium, magnesium, manganese, zirconium, lead, antimony and titanium, each in an amount in excess of 0.001% and less than 0.1% by weight.

11. Process according to claim 2, wherein said casting step further includes adding at least one material selected from the group consisting of aluminum, silver, boron, beryllium, calcium, chromium, cobalt, indium, lithium, magnesium, manganese, zirconium, lead, antimony and titanium, each in an amount in excess of 0.001% and less than 0.1% by weight.

12. Process according to claim 1, wherein said casting step comprises casting a copper base alloy consisting essentially of tin in an amount from 2.5 wt. % up to 4.0 wt. %, phosphorous from 0.01 wt. % up to 0.2 wt. %, iron from 0.05 wt. % up to 0.8 wt. %, zinc in an amount from greater than 1 wt. % to 5.0 wt. %, and the balance copper.

13. Process according to claim 1, wherein said casting step comprises casting a copper base alloy consisting essentially of tin in an amount from 2.0 to 4.0 wt. %, phosphorous from 0.01 to 0.2 wt. %, iron from 0.01 to 0.8 wt. %, zinc in an amount greater than 1.0 wt. % and less than 8.0 wt. %, a material selected from the group consisting of nickel, cobalt and mixtures thereof in an amount from 0.001 to 0.5 wt. % each, up to 0.1 wt. % magnesium, at least one metal selected from the group consisting of aluminum, silver, boron, beryllium, calcium, chromium, cobalt, indium, lithium, magnesium, manganese, zirconium, lead, silicon, antimony, and titanium each in an amount in excess of 0.001 wt. % and less than 0.1 wt. %, and the balance copper.

14. Process according to claim 1, wherein said casting step comprising casting a copper base alloy consisting essentially of tin in an amount from 2.0 wt. % up to 4.0 wt. %, phosphorous from 0.01 to 0.2 wt. %, iron from 0.01 to 0.8 wt. %, zinc in an amount greater than 1.0 wt. % and less than 8.0 wt. %, and the balance copper.

15. Process for preparing copper base alloys which comprises: casting a copper base alloy consisting essentially of tin in an amount greater than about 1.5 wt. % up to 4.0 wt. %, phosphorous from 0.01 to 0.20 wt. %, iron from 0.01 to 0.80 wt. %, zinc in an amount greater than 1.0 wt. % up to 8.0 wt. %, and the balance essentially copper; homogenizing at least once for at least one hour at from 1000–1450° F.; rolling to final gauge including at least one process anneal for at least one hour at 650–1200° F. followed by slow cooling; and stress relief annealing at final gauge for at least one hour at 300–600° F., thereby obtaining a copper alloy including phosphide particles uniformly distributed throughout the matrix of said copper base alloy.

* * * * *